US006106018A

United States Patent [19]

McKeown et al.

[11] Patent Number: 6,106,018

[45] Date of Patent: Aug. 22, 2000

[54] COVER MOUNTED TAB INDEX SYSTEM

[75] Inventors: Timothy E. McKeown, Glen Ellyn; Fred E. Cecala, Mount Prospect; Marcia E. Lausen, Evanston, all of Ill.; Julian F. Brown, Bradford on Avon, United Kingdom

[73] Assignee: Acco Brands, Inc., Lincolnshire, Ill.

[21] Appl. No.: 09/384,440

[22] Filed: Aug. 27, 1999

[51] Int. Cl.[7] ..... B42F 21/00

[52] U.S. Cl. ..... 283/36; 283/37; 283/41; 281/37; 281/31

[58] Field of Search ..... 281/29, 31, 37, 281/42, 45, 51; 402/4, 70, 73; 283/36–42

[56] References Cited

U.S. PATENT DOCUMENTS

| | | | |
|---|---|---|---|
| Re. 9,249 | 6/1880 | Bonnell . | |
| 356,334 | 1/1887 | Rosewater . | |
| 371,791 | 10/1887 | Rosewater . | |
| 422,971 | 3/1890 | Pratt . | |
| 501,508 | 7/1893 | Hays . | |
| 576,295 | 2/1897 | Watts et al. . | |
| 600,253 | 3/1898 | Barnes . | |
| 629,214 | 7/1899 | Simpson . | |
| 685,257 | 10/1901 | Colvin . | |
| 1,026,804 | 5/1912 | Hare . | |
| 1,099,803 | 6/1914 | Irwin . | |
| 1,117,146 | 10/1914 | Olson . | |
| 1,492,932 | 5/1924 | Orrell . | |
| 1,559,129 | 10/1925 | Pimm . | |
| 3,823,491 | 7/1974 | Lehmann | 281/37 X |
| 4,832,372 | 5/1989 | Young | 281/31 |
| 5,489,120 | 2/1996 | Thornsburg | 281/33 |
| 5,732,976 | 3/1998 | Snyder | 281/37 X |
| 5,901,982 | 5/1999 | Couper | 281/31 |
| 6,017,062 | 1/2000 | White | 281/31 X |

FOREIGN PATENT DOCUMENTS

| | | |
|---|---|---|
| 800.140 | 6/1936 | France . |
| 64843 | 12/1955 | France . |
| 542419 | 1/1932 | Germany . |
| 674980 | 1/1966 | Germany . |
| 205682 | 6/1966 | Sweden . |

*Primary Examiner*—Willmon Fridie, Jr.
*Attorney, Agent, or Firm*—Pennie & Edmonds LLP

[57] ABSTRACT

A tab index system is provided for attachment to the cover of a typical three-ring style loose leaf binder. The index system includes a plurality of tabbed dividers having a plurality of tabs and a card holder containing a removable label card. The label card includes a plurality of labels corresponding to the tabs.

16 Claims, 7 Drawing Sheets

A
B
1
3
5
7
9
11
13
15
17
19
20
21
25a
25b
25c
27
28
List of Contacts
Meeting Notes
Budgets
Technical Issues
Travel Records

COVER MOUNTED TAB INDEX SYSTEM

BACKGROUND OF THE INVENTION

Binders, books, and folders typically have two covers that pivot with respect to a binding assembly such as a spine. Dividers have been provided for folders and books to indicate visually various divisions, sections, or chapters thereof and to permit easy access to any one of these divisions. These dividers are constructed of material generally more rigid than the pages bound therein and contain a portion that extended beyond at least one edge of the pages. Portions of the dividers extending beyond the edge of the pages were used to hold alpha-numeric indicia corresponding to the contents of the divisions. Since these portions do not extend a large distance beyond the edge of the pages or the entire length of the edges, the area provided for the indicia is limited, restricting the amount of information that can be placed on the portion or requiring the use of cryptic abbreviations.

U.S. Pat. No. 629,214 shows a book with a supplemental sheet which is attached to the exposed interior of covers of the book. In this patent, the supplemental sheet is attached by pasting in place. These supplemental sheets could not be re-used and were sized for the specific exposed area of the interior cover. Therefore, additional new supplemental sheets would have to be used as the type or number of divisions was changed.

U.S. Pat. No. 1,117,146 disclosed removable name-slips placed in a series of holders attached to the interior cover of an account book. The removable name-slips were arranged to correspond to the spacing of the extended portions of the dividers. Again, the holders and name-slips were custom sized for the interior cover.

The need exists for a single index system that can be used for various sized binders or folders, which allows changes in the number of binder divisions, the description of binder divisions, and the exposed cover interior area, and which would advantageously not prevent access to other features located on the cover interior.

SUMMARY OF THE INVENTION

In accordance with the present invention, a cover mounted tab index system is provided for use in a folder or binder. The index system includes a plurality of index tabs attached to the binder and arranged to align with a cover-mounted card-holder having a label card. The card holder is attached to the inside of either the front or the back cover.

The card holder is made of transparent plastic and includes an adhesive running along an edge of the card holder for attaching to the outer edge of the binder cover. Therefore, the card holder can be pulled away from the binder cover to expose and permit access to pockets or other features located on the cover interior.

The label card is sized to accommodate various exposed interior cover areas and includes a plurality of labels or divisions arranged to correspond to and align with the plurality of index tabs. Guide markings are provided on the label card to indicate the available label area for a given number of index tabs and exposed cover interior area. The label card can be inserted into and removed from the label holder for replacement or modification. The label card is arranged in a standard sized sheet of paper that can be used with printers or photo-copiers. Additionally, multiple label cards can be provided on the single standard sized sheet.

DETAILED DESCRIPTION OF THE PREFERRED EMBODIMENTS

Figure 1:
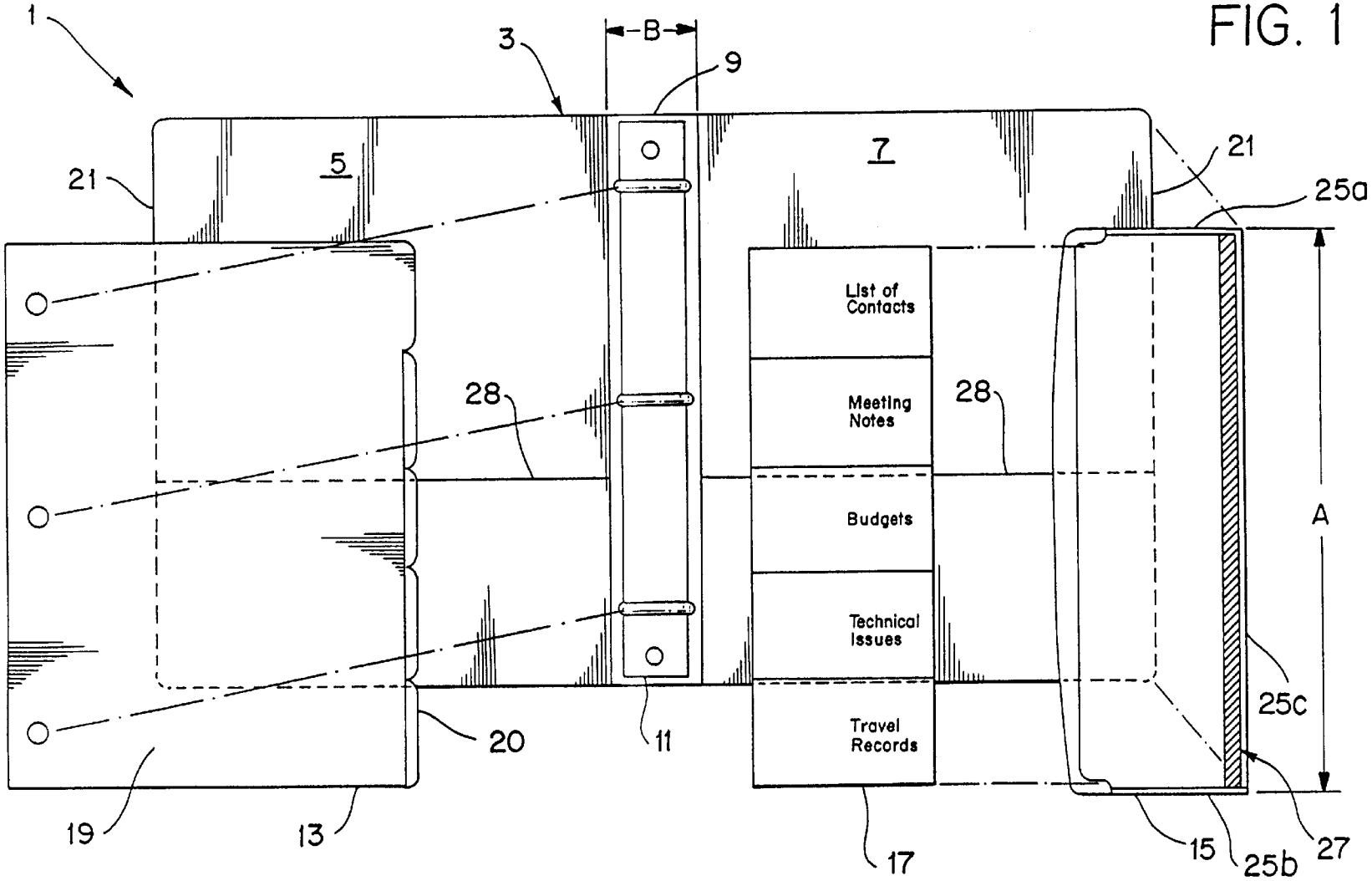
FIG. 1 is an exploded plan view of the index system in an O-ring binder.

Referring initially to FIG. 1, the cover mounted tab index system 1 preferably includes a binder 3, such as a 3-ring binder, having a first front cover 5, a second back cover 7, and a spine 9 connected between the front and back covers 5 and 7. The binder 3 includes a binding mechanism 11 attached to either cover 5 or 7 or the spine 9, preferably for releasably securing pages or sheets of paper to the binder 3. Suitable binding mechanisms include clamps, clasps, hooks, and ring-type mechanisms. The present invention, however, is equally well suited for non-releasable paper binding attachments such as is used in books and manuals, including glue, spiral binding, and attachments using multiple fixed posts to engage holes in the paper, such as VeloBind®-type bindings.

Figure 2:
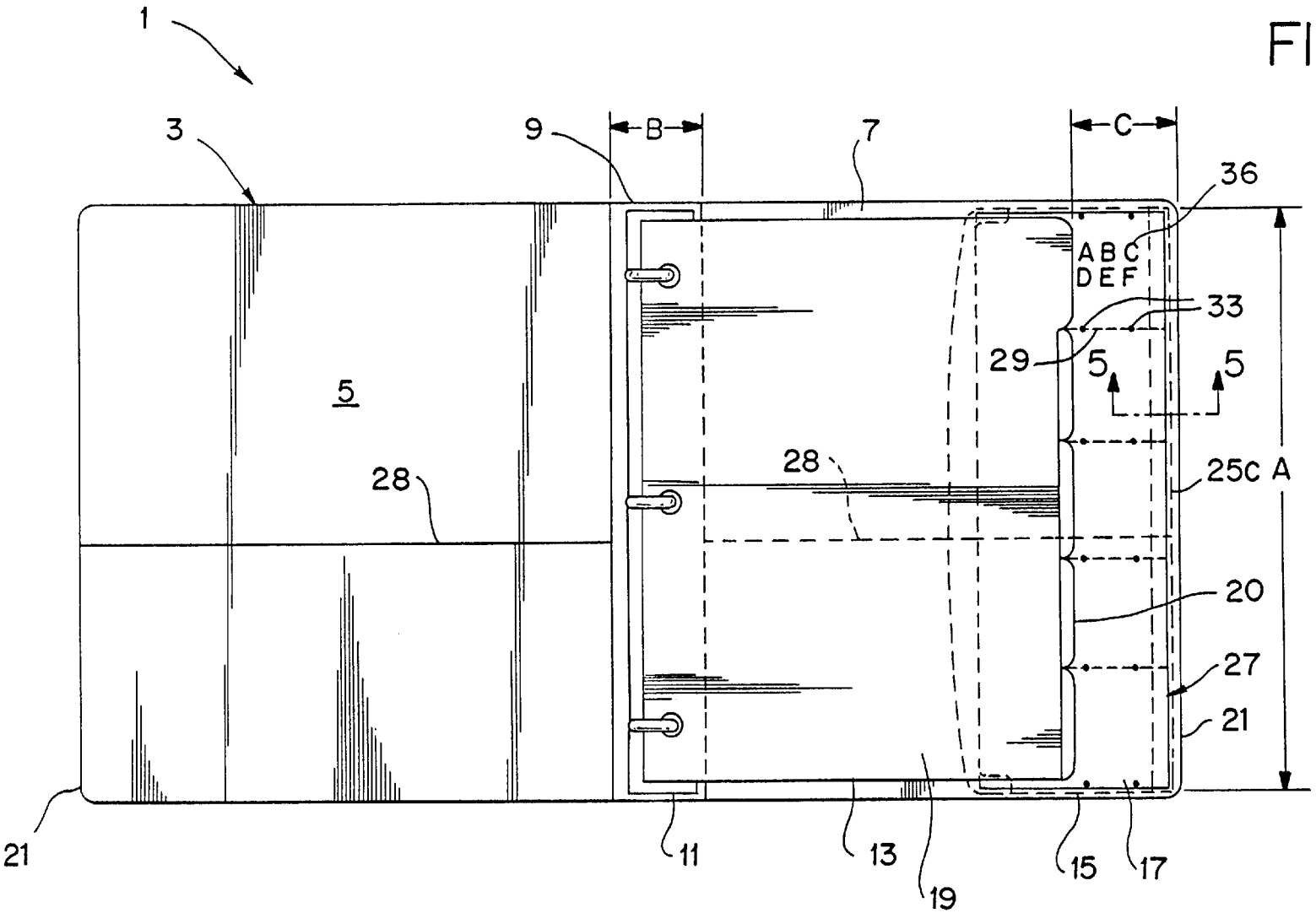
FIG. 2 is a plan view of the index system in an O-ring binder having a first binding width.
Figure 3:
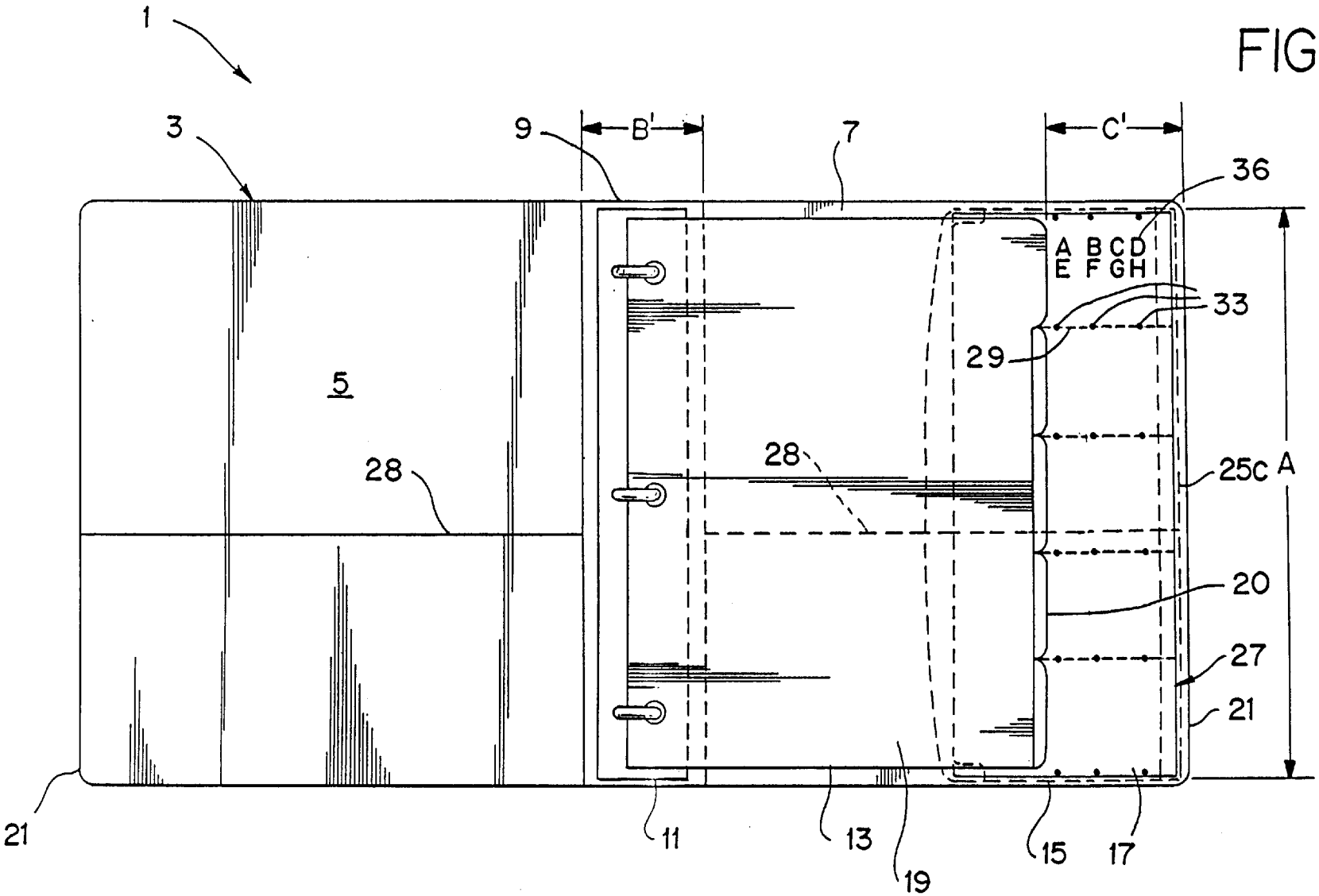
FIG. 3 is a plan view of the index system in an O-ring binder having a second binding width.

The tab index system 1 includes a plurality of tabbed dividers 13, a card holder 15, and a label card 17. Each one of the plurality of tabbed dividers 13 includes a body 19 and a tab 21. The tabbed dividers 13 are sized and arranged such that the tabs 20 extend or protrude so as to be visible when the attached sheets of paper and plurality of tabbed dividers 13 are stacked upon each other as is shown in FIGS. 2 and 3. Generally, the tabbed dividers 13 are secured to the binder 3 by the binding mechanism 11 and are constructed of material more rigid or stiff than the sheets of paper contained therein. Suitable materials include plastics, paper, cardboard, and combinations thereof. The tabbed dividers 13 may be transparent, translucent, or opaque either in whole or in part and may either collectively be monochromatic or a mixture of colors.

At least one card holder 15 is provided. The card holder 15 is sized to accommodate an existing binder and may be attached to either the front cover, back cover, or both the front and back cover, such as where more than one card holder 15 is provided. The length A of the card holder 15 is preferably selected to correspond generally to the height of covers.

Figure 4:
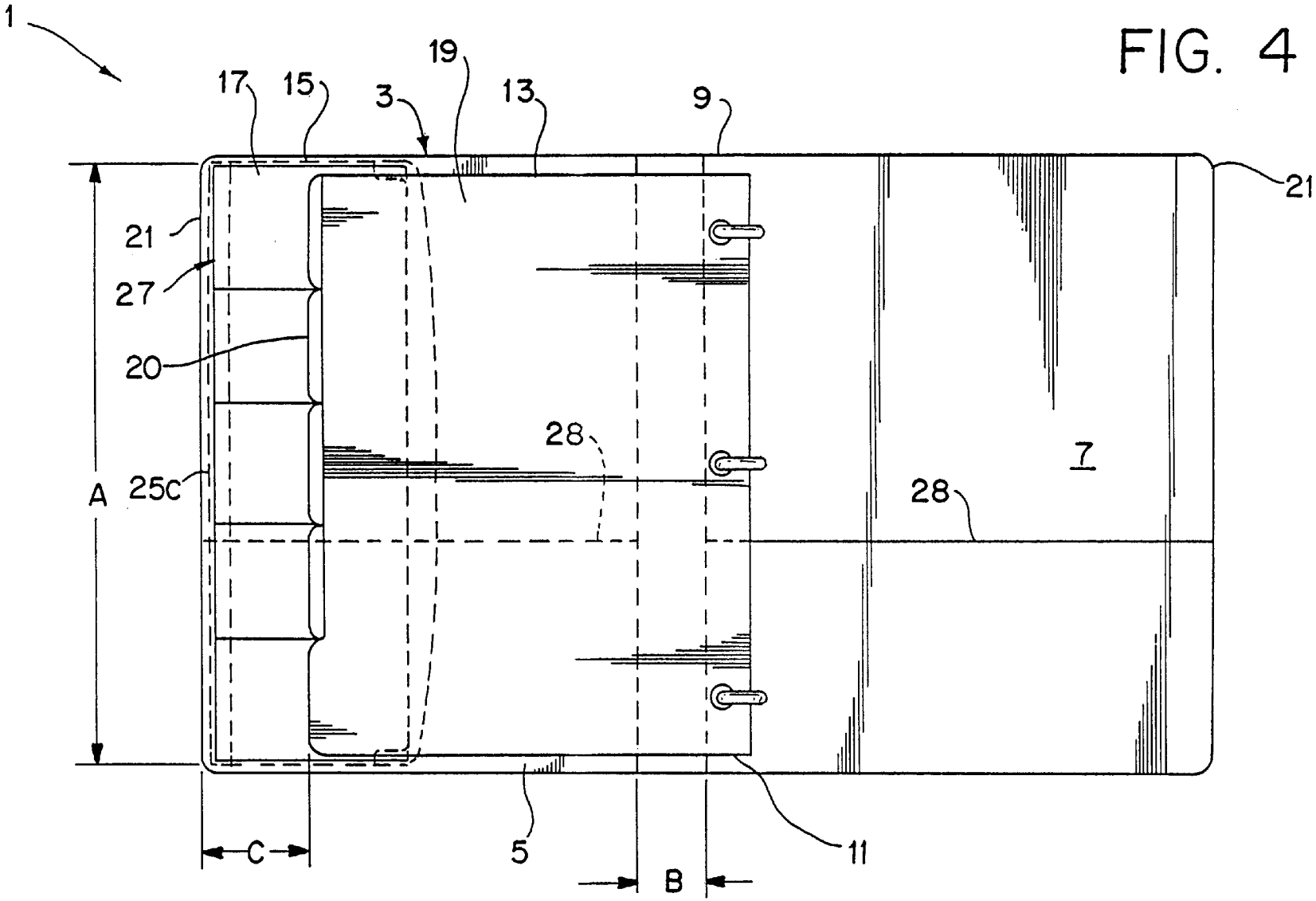
FIG. 4 is a plan view of the index system in a D-ring binder.

For a given length A, the card holder 15 is of sufficient size to accommodate various spine 9 widths B and binding mechanism sizes, such as ring diameters of the binder 3. As is best shown in FIG. 2, for a typical spine mounted O-ring mechanism, the width B of the spine 9 will result in a corresponding width C of exposed interior front or back cover when the binder 3 is open, because the papers attached to the mechanism 11 will retract from the cover edges 21 when the binder 3 is opened. As is shown in FIG. 3 for a larger width B' of the spine 9, a corresponding greater width C' of the interior front or back cover is exposed. Referring now to FIG. 4, for a back cover mounted D-ring mechanism, the corresponding width C will preferably result on the interior of the front cover 5, with the card holder 15 mounted to the front cover 5.

The ring size and spine 9 width B of standard binders vary in discrete steps. Such spine sizes include 0.5", 1", 1.5", 2", 3". Therefore, the card holder is preferably sized to accommodate the maximum width of exposed interior cover C corresponding to a given style binder 3.

Figure 5:
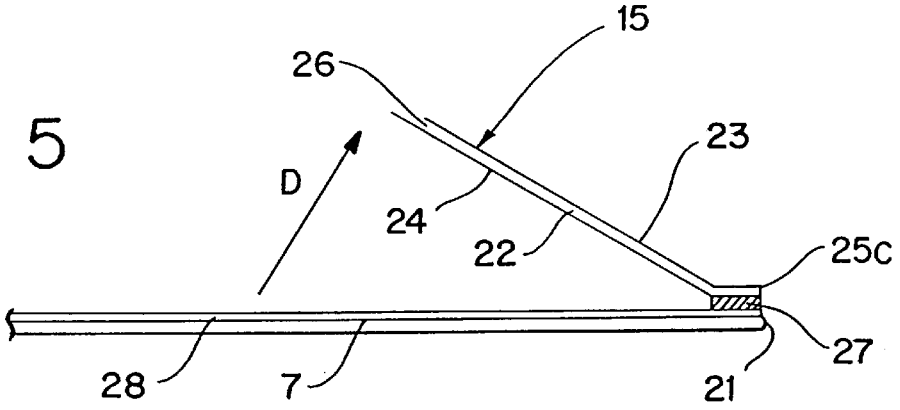
FIG. 5 is a partial view through line 5—5 of FIG. 2, showing the binder cover and label pocket pulled away from the cover.

The card holder 15 is preferably constructed to hold the label card 17 so as to permit removal for editing and replacement. The card holder 15 shown in FIG. 5 is a pocket 22 that is sized to accommodate the label card 17. The pocket 22 is formed from a front sheet 23 of material and a back sheet 24 of material made from either a single sheet of material folded over upon itself or two or more separate sheets of material attached along preferably top, bottom, and outside edges 25*a*, 25*b*, and 25*c*. When a single sheet of material is used, the fold line preferably defines a closed edge 25 of the pocket 22. When two separate sheets of material are used, the closed edge 25*c* is preferably defined by the seam joining the sheets of material. This closed edge 25*c* is sized to correspond approximately to dimension A of the binder 3 or preferably slightly larger than the height of the stack of paper to be bound in the binding mechanism 11. The card holder 15 also includes an opening 26 to provide for insertion of the label card 17. Preferably, the opening 26 runs along an edge opposite the closed outside edge 25*c* and faces into the interior of the binder 1. The pocket 22 allows easy insertion and removal of the label card 17 and protects the inserted label card 17. The card holder 15 may be constructed of transparent, translucent, colored, or opaque materials or combinations thereof, for example, opaque materials with transparent windows. Suitable materials for the card holder 15 include plastics such as vinyl, polypropylene, and combinations thereof.

Figure 6:
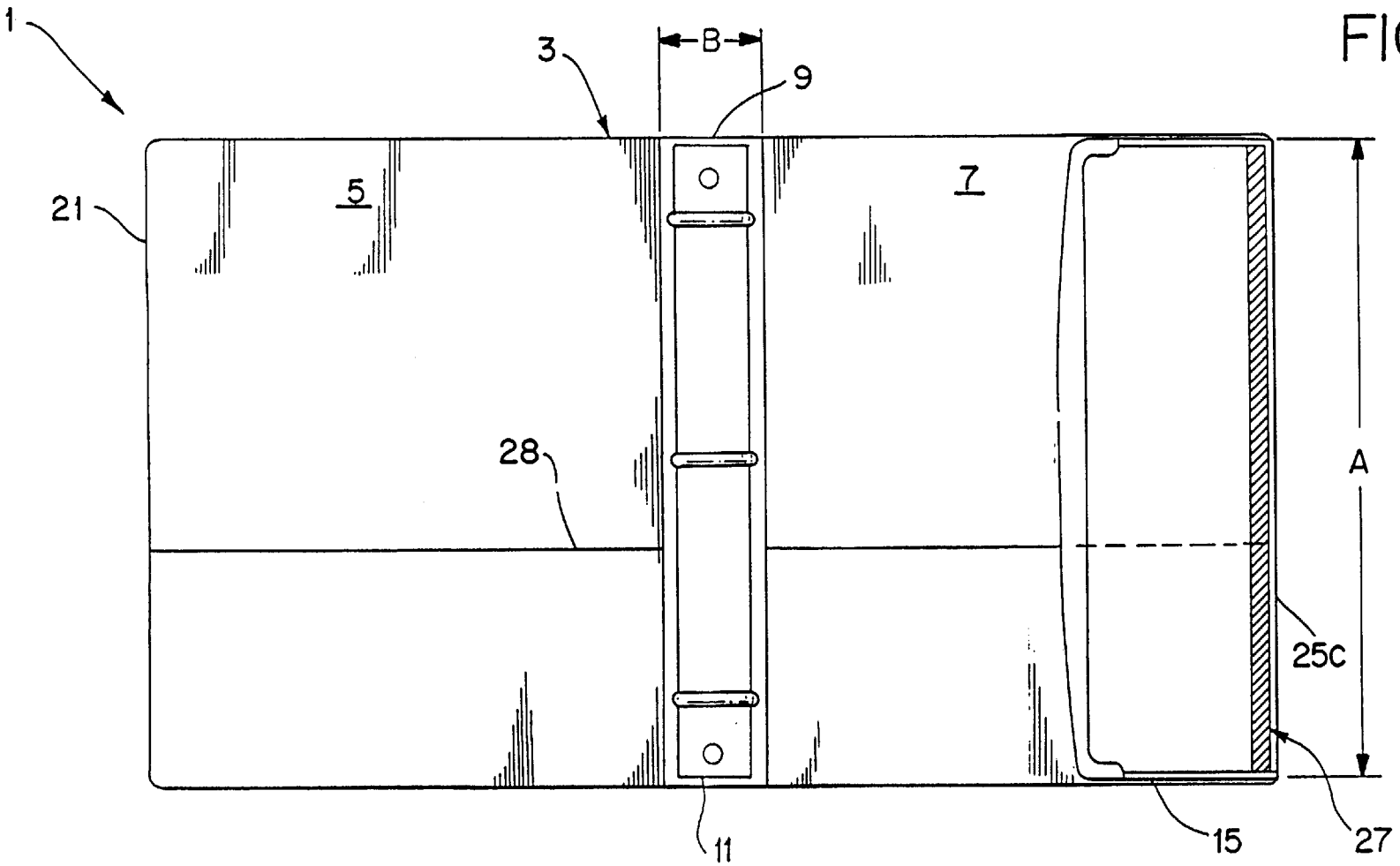
FIG. 6 is a plan view of the card holder of the present invention inserted in a binder.

The card holder 15 is either fixedly or releasably secured to the binder 3. The card holder 15 can be secured by clips, staples, hooks, rivets, welds, or adhesives. Preferably, the card holder 15 is attached to binder 3 by an adhesive strip 27 disposed on at least an adherable portion of either the front piece 23 or the back piece 24, preferably the back piece. The card holder 15 can extend across the covers, obscuring an area of the covers having features such as paper pockets 28. Therefore as is shown in FIG. 6, the adhesive strip 27 is preferably limited to only a portion of the card holder 15. Preferably, the adhesive strip 27 runs adjacent the closed edge 25*c* of the card holder 15, which upon placement of the card holder 15 in the binder 3, runs along and is adjacent to the cover edges 21. Therefore, the remaining areas define a free section of the card holder 15 not attached to the binder 3. Thus as shown in FIG. 5, the free section of the card holder 15 may be pivoted, pulled, or lifted away from the cover 7 in the direction of arrow D to uncover the previously covered area and to provide access to other features on the cover such as pockets 28. Preferably, the opening 26 of the pocket 22 is disposed in the free section.

The label card 17 is made of a material capable of holding or accepting text. Preferably, the label card 17 is made of paper or cardboard. Where the card holder 15 is arranged as a pocket, the label card 17 is sized to fit inside the pocket 22. The label card 15 is preferably further sized to provide the maximum amount of label area possible, therefore the label card 17 preferably has a corresponding width of at least C.

Figure 7:
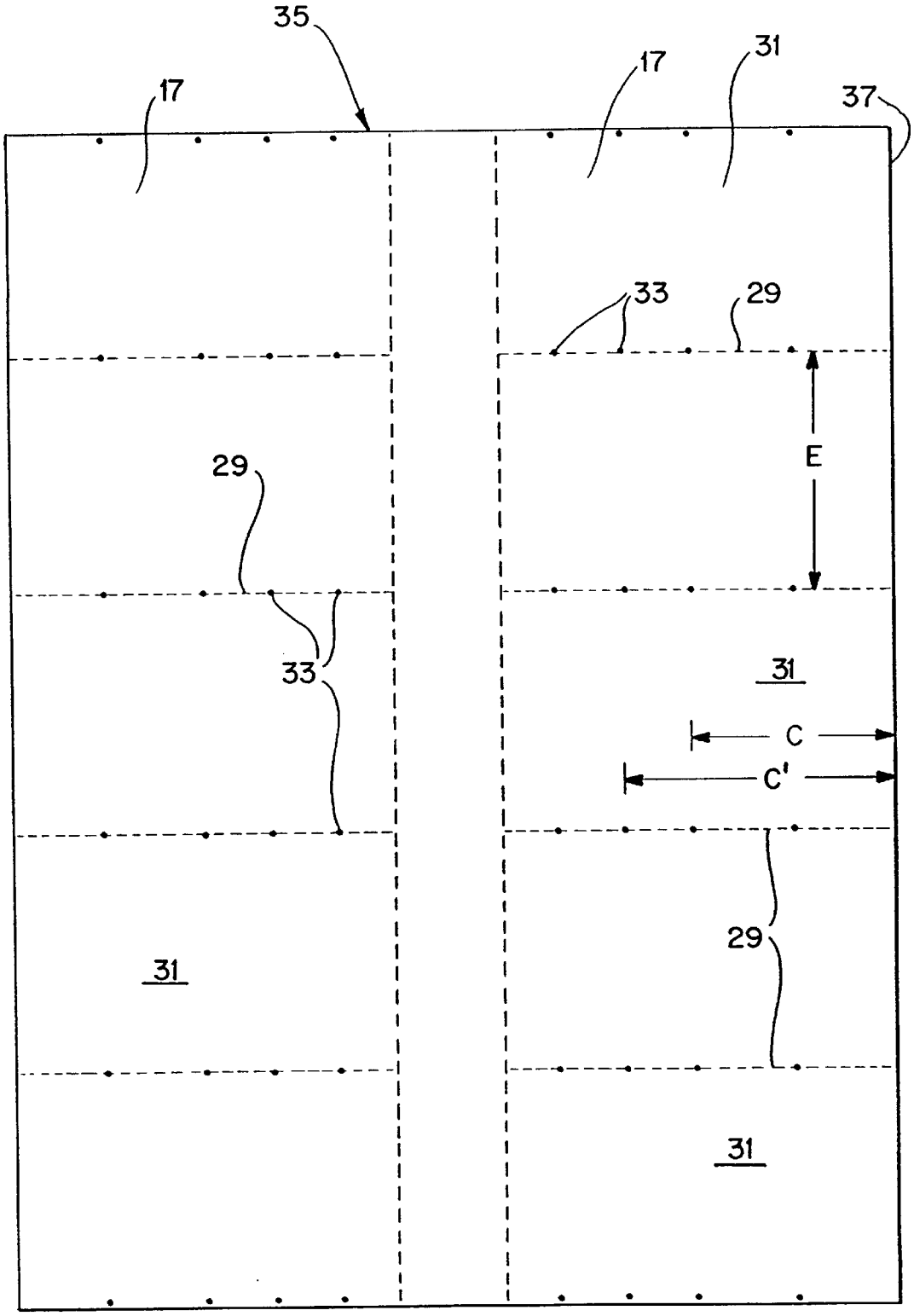
FIG. 7 is a plan view of a sheet containing the label card.

Referring to FIG. 7, the label card 17 contains a plurality of label separators, which are preferably printed indicia such as dividing lines 29, segmenting the label card 17 into the appropriate number of labels 31 to correspond to and align with the number of tabs 20. Preferably, the dividing lines 29 are made up of a series of dots. The dividing lines 29 include a plurality of width indicators 33 spaced from the edges 21 of the covers or of the card 17 by a distance C, which depends on the spine width B, indicating the amount of label area between edge 37 of the card 17 available for labeling for a given binder configuration. Preferably, the width indicators 33 are also dots but are sized to be larger than the dots of the dividing lines 29. In another embodiment, the indicators are vertical lines. Therefore, for a given label writing width C in FIG. 2, the area available for the indicia 36 is indicated by the second indicator 33 from the outside edge 25*c*, while for a greater width C' in FIG. 3, the area available for the indicia 36 is indicated by the third width indicators 33 from the outside edge 25*c*. The width C may provide an additional clearance from the position of the tabbed dividers when the binder is open.

For a ring binder with round rings mounted on a spine with a half inch spine width B, distance C to the first indicator is preferably about 1 1/32 inch. For a spine width B of one inch, the distance C to the second indicator is preferably about 2 1/64 inch. For a spine width B of 1.5 inches, the distance C to the third indicator will be about 2 5/16 inches. For a spine width B of two inches, the distance C to the fourth indicator is preferably about 3 1/4 inches. For a spine width B of three inches, the distance C to the fifth indicator, which is preferably the edge of the card 17, distance C is about 3 3/4 inches. Where the pocket only allows placement of the card at a predetermined distance from the edge 21 of the binder, the distance C to each of the indicators 33 is preferably reduced by the distance of the card edge 25*c* from the binder edge 21.

As is best shown in FIG. 7, in order to facilitate use of the label card 17 with photocopiers and printers, the label card 17 can be provided on a standard-sized sheet 35, such as 8.5"×11", 8.5"×14", or A4 size. Depending on the size of the sheet 35 and the label card 17, multiple label cards 17 may be included on a single sheet 35.

Figure 8:
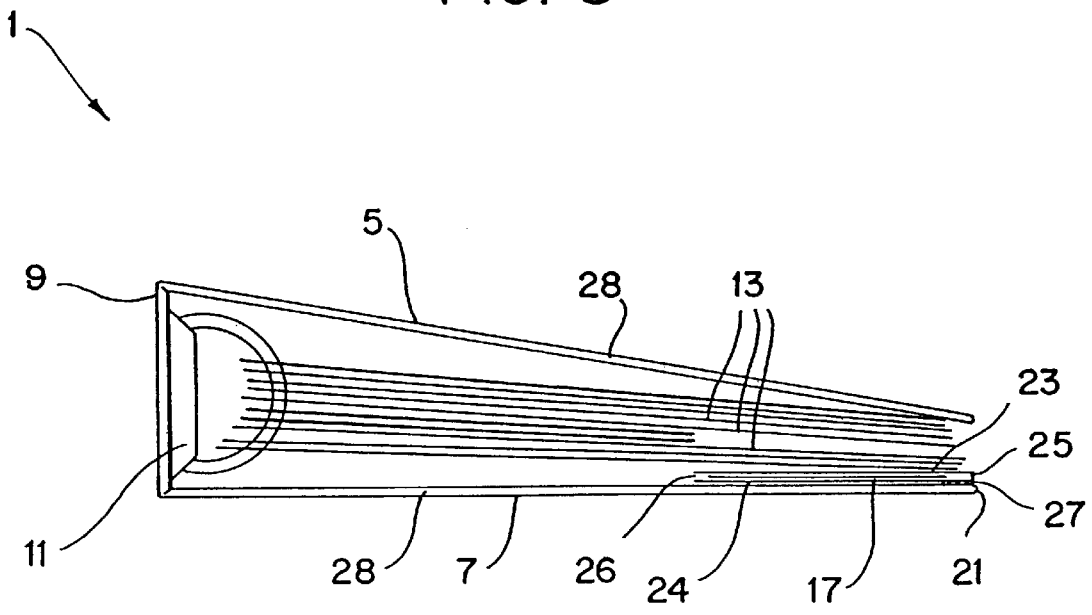
FIG. 8 is a bottom elevational view of the tab index system in a closed binder.

When inserted into a card holder 15 attached to a binder having tabs 20, the labels 31 correspond to the tabs 20. When the binder 1 is closed as shown in FIG. 8, a larger portion of the card holder 15, label card 17, and label area 37 are covered by the tabbed dividers 13. Upon opening of the binder 1, the label cards 17, and label area 37 are exposed by an additional amount, with a total exposure of width of about C, corresponding to width B as is shown in FIG. 2. The number of labels 31 containing indicia 36 correspond to the number of tabbed dividers 13. Each tab 20 falls within the dividing lines 29 of the associated label 31 and may be any suitable size up to the height E of the label.

One of ordinary skill in the art can envision numerous variations and modifications. For example, a card holder and label card can be provided for both the front and back covers, or the card holder can include a plurality of pockets for separate labels. All of these modifications are contemplated by the true spirit and scope of the following claims.

What is claimed is:

1. A tab index system comprising:

(a) a folder having first and second covers pivotably joined together;

(b) a binding mechanism capable of securing a stack thereto;

(c) a plurality of dividers securable to the binding mechanism and including tabs that project laterally beyond the stack;

(d) at least one label holder attached to the cover and including a pivotable portion connected that is movable between:

(i) a first position adjacent the first cover and covering an area thereof, and (ii) a second position exposing said area; and (e) a plurality of labels associated with the label holder in alignment with the tabs with the labels being visible adjacent the tabs when the label holder is in the first position.

2. The index system of claim 1, wherein the first cover has a pocket with at least a portion thereof disposed in said area.

3. The index system of claim 1, wherein label holder includes an adherable portion connected to the pivotable portion and being adherable to the first cover.

4. The index system of claim 1, wherein:

(a) the card holder is a pocket having an opening for receiving the labels and including a transparent front sheet permitting viewing of the labels.

5. The index system of claim 1, wherein the binding mechanism is attached to a portion of the folder other than the first cover.

6. The index system of claim 5, wherein the binding mechanism is attached to the second cover.

7. The index system of claim 5, wherein:

(a) the folder includes a spine pivotably connected between the first and second covers; and (b) the binding mechanism is attached to the spine.

8. The index system of claim 7, wherein the binding mechanism comprises a ring binder.

9. A tab index system comprising:

(a) a card attachable to a binder holding a plurality of sheets, the card having a front surface capable of displaying labels and an outer edge;

(b) a plurality of indicators including at least first and second indicators on the front surface:

(i) the first indicator being spaced from the edge of the card at a first distance corresponding to a first configuration of the binder such that when the binder is open with the card attached thereto in a predetermined mounting position, the sheets are retracted away from the outer edge and is adjacent the first indicator revealing a first label area of the front surface;

(ii) the second indicator being spaced from the edge of the card at a second distance corresponding to a second configuration of the binder such that when the binder is open with the card attached thereto in the predetermined mounting position, the sheets is retracted away from the outer edge and is adjacent the second indicator revealing a second label area of the front surface greater than the first.

10. The index system of claim 9, wherein the binder of the first and second configurations includes front and back covers, a spine, and a binder mechanism with round rings attached to one of the covers or the spine for attaching the sheets thereto.

11. The index system of claim 9, wherein in the predetermined mounting position, the outer edge is adjacent an edge of the binder.

12. The index system of claim 9, further comprising a plurality of dividers securable to the binding mechanism and which are part of the sheets, the sheets including a stack, and the dividers including tabs that project laterally beyond the stack;

wherein the tabs cover a portion of the label area when the binder is closed, and are retracted to adjacent one of the indicators when the binder is open.

13. The index system of claim 12, wherein the card includes separators disposed on the front surface dividing portions of the front surface in alignment with each tab.

14. The index system of claim 9, further comprising a label holder including a pocket with a transparent front sheet and having an opening for receiving the labels and a pocket end for limiting the insertion of the card at a the mounting position.

15. The index system of claim 9, wherein:

(a) the card is provided on a standard sized sheet of material to be used in a printer.

16. The index system of claim 15, wherein:

(a) the standard size sheet of material contains at least two label cards.

* * * * *